US007136020B2

(12) United States Patent
Yamaki

(10) Patent No.: US 7,136,020 B2
(45) Date of Patent: Nov. 14, 2006

(54) ANTENNA STRUCTURE AND COMMUNICATION DEVICE USING THE SAME

(75) Inventor: Kazuhisa Yamaki, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/978,640

(22) Filed: Nov. 1, 2004

(65) Prior Publication Data

US 2005/0099347 A1 May 12, 2005

(30) Foreign Application Priority Data

Nov. 12, 2003 (JP) ..... 2003-382777

(51) Int. Cl.
*H01Q 1/24* (2006.01)

(52) U.S. Cl. ..... 343/702; 343/700 MS

(58) Field of Classification Search ..... 343/700 MS, 343/702, 846, 876
See application file for complete search history.

(56) References Cited

U.S. PATENT DOCUMENTS 6,034,636 A * 3/2000 Saitoh ..... 343/700 MS
6,300,909 B1 * 10/2001 Tsubaki et al. ..... 343/700 MS
6,693,594 B1 * 2/2004 Pankinaho et al. .. 343/700 MS
6,803,881 B1 * 10/2004 Ishihara et al. ..... 343/700 MS

FOREIGN PATENT DOCUMENTS

JP 07-297627 11/1995
JP 10-107671 4/1998

* cited by examiner

*Primary Examiner*—Tan Ho
(74) *Attorney, Agent, or Firm*—Keating&Bennett, LLP

(57) ABSTRACT

An antenna structure includes a capacitance-rendering portion located between an open end portion of a feed radiation electrode and a ground portion. A switch for changing the capacitance between the open end portion of the feed radiation electrode and the ground portion rendered by the capacitance-rendering portion is provided. When the capacitance between the open end portion of the feed radiation electrode and the ground portion is increased by the capacitance-rendering portion, a resonant frequency in the fundamental frequency band, caused by the antenna operation of the feed radiation electrode, is reduced corresponding to the increased amount of the capacitance. When the capacitance between the open end portion of the feed radiation electrode and the ground portion is decreased by the changing operation of the capacitance-rendering portion, the resonant frequency in the fundamental frequency band is increased corresponding to the decreased amount of the capacitance.

13 Claims, 6 Drawing Sheets

ANTENNA STRUCTURE AND COMMUNICATION DEVICE USING THE SAME

BACKGROUND OF THE INVENTION

1. Field of the Invention

The present invention relates to an antenna structure suitable for multi-band radio communication which is performed in a plurality of different frequency bands, and to a communication device including the same.

2. Description of the Related Art

FIG. 6A is a schematic perspective view showing an example of an antenna structure suitable for multi-band radio communication which is performed in a plurality of different frequency bands. The antenna structure 1 includes a base plate 2 (e.g., a circuit board of a communication device), a dielectric substrate 3 mounted on one side end portion of the base plate 2, a feed radiation electrode 4, a non-feed radiation electrode 5, and a ground portion 6 provided on the base plate 2.

The feed radiation electrode 4 and the non-feed radiation electrode 5 are λ/4 type electrodes. An area Zant on the base plate 2 where the feed radiation electrode 4 and the non-feed radiation electrode 5 are arranged is a non-ground area in which the ground portion 6 is not provided. The dielectric substrate 3 is disposed on the non-ground area Zant. The feed radiation electrode 4 is configured so as to extend from the upper surface 3U of the dielectric substrate 3 onto the base plate 2 via an end surface 3L thereof on the left side as viewed in FIG. 6A. One side end portion K of the feed radiation electrode 4, located on the base plate 2, is an open end portion, while the other side end portion Q of the feed radiation electrode 4 is a feed end portion. The feed end portion Q is connected to, e.g., a high frequency circuit 10 of a communication device for radio communication via a feed electrode 7 provided on a side surface 3B of the dielectric substrate 3 and a feed conductor pattern 8 provided on the base plate 2. The portion 4A of the feed radiation electrode 4 provided on the base plate 2 functions as a portion of the feed radiation electrode 4, and moreover, functions as an underlying electrode (fixing electrode) for soldering when the dielectric substrate 3 is mounted onto the base plate 2, e.g., using solder.

The non-feed radiation electrode 5 is arranged adjacent to the feed radiation electrode 4 with an interval therebetween. In FIGS. 6A and 6B, the non-feed radiation electrode 5 is arranged so as to extend from the upper surface 3U of the dielectric substrate 3 onto an end surface thereof on the right side viewed in FIGS. 6A and 6B. The top of the extended non-feed radiation electrode 5 is an open end portion. The end portion G on the opposed side of the non-feed radiation electrode 5 is connected to the ground portion 6 of the base plate 2 via a ground connection electrode 11 provided on a side surface 3B of the dielectric substrate 3. Thus, the end portion G is a ground end portion.

The feed radiation electrode 4 and the non-feed radiation electrode 5 are electro-magnetically coupled to each other (coupling by electric fields and magnetic fields). The feed radiation electrode 4 has a plurality of resonant frequencies. In this case, the frequency band having the lowest resonant frequency f1 of the plurality of resonant frequencies is called a fundamental frequency band, while the frequency band having a resonant frequency f2 higher than the resonant frequency f1 is called a higher-order frequency band. In this example, the non-feed radiation electrode 5 has a resonant frequency f2' shown at a position near the resonant frequency f2 of the feed radiation electrode 4 on the higher order side thereof in the graph of FIG. 6C. As seen in the VSWR (Voltage Standing Wave Ratio) characteristic shown by solid line in FIG. 6C, the feed radiation electrode 4 and the non-feed radiation electrode 5 generate a double resonant state in the higher-order frequency band. If only the feed radiation electrode 4 is provided, the width of the higher-order frequency band is smaller than that of the fundamental frequency band. Thus, for example, in some cases, the higher-order frequency band is unsuitable for use in radio communication because of the insufficient bandwidth. On the other hand, when the non-feed radiation electrode 5 is provided, so that the feed radiation electrode 4 and the non-feed radiation electrode 5 generate a double resonant state in the higher-order frequency band, the higher-order frequency band, together with the fundamental frequency band, can be used for radio communication. That is, this antenna structure 1 is suitable for the multi-band radio communication.

In the above-described antenna structure 1, a transmission signal is transmitted from the high frequency circuit 10 to the feed end portion Q of the feed radiation electrode 4 via the feed conductor pattern 8 and the feeding electrode 7, the signal is also transmitted to the non-feed radiation electrode 5 through the feed radiation electrode 4 via the electromagnetic coupling. If the transmission signal is a signal in a frequency band corresponding to the fundamental frequency band, the feed radiation electrode 4 resonates with the supplied transmission signal to radiate the transmission signal. If the transmission signal corresponds to the higher-order frequency band, not only the feed radiation electrode 4 but also the non-feed radiation electrode 5 resonate with the signal, such that the feed radiation electrode 4 and the non-feed radiation electrode 5 generate a double resonant state, and thus, the transmission signal is radiated.

Moreover, if an external signal is supplied, and the feed radiation electrode 4 and the non-feed radiation electrode 5 resonate with the signal to receive, the received signal is transferred to the high frequency circuit 10 via the feeding electrode 7 and the feed conductor pattern 8.

In some cases, for example, radio communication at a plurality of different frequencies is performed, in which, at signal reception Rx, the resonant frequency in the fundamental frequency band is changed to the frequency f1 as shown by solid line in FIG. 6C, and at signal transmission Tx, the resonant frequency in the fundamental frequency band is changed to the frequency f1' shown by dotted line in FIG. 6C (e.g., see Japanese Unexamined Patent Application Publication Nos. 7-297627 and 10-107671).

To change the resonant frequency in a frequency band, a variable inductance component is provided in a line connecting the feed end portion Q of the feed radiation electrode 4 to the high frequency circuit 10. This is specifically described with reference to FIG. 6B below. As shown in FIG. 6B, a parallel combination of a connection line 14 including an inductor 13 incorporated therein and a short-circuit line 15, and a switch 16 are incorporated in a line connecting the feed end portion Q of the feed radiation electrode 4 to the high frequency circuit 10. The switch 16 is configured to selectively change one of the connection line 14 and the short-circuit line 15 of the parallel combination to the other. When the connection line 14 is connected to the feed end portion Q of the feed radiation electrode 4 by switching of the switch 16, the inductance of the inductor 13 in the connection line 14 is provided, in series, to the feed radiation electrode 4. When the short-circuit line 15 is connected to the feed end portion Q of the feed radiation electrode 4, the inductance of the inductor 13 ceases from being provided to the feed radiation electrode 4. Thus, the inductor 13 is switched so as to be present or absent between the feed radiation electrode 4 and the high frequency circuit 10. That is, the state in which the inductance of the inductor 13 is provided to the feed radiation electrode 4, and the state in which the inductance of the inductor 13 is not provided to the feed radiation electrode 4 can be selected. Thereby, the resonant frequencies in the fundamental frequency band can be changed to each other. That is, for example, the resonant frequency in the fundamental frequency band become, e.g., the frequency f1' shown by the dotted line in FIG. 6C when the inductance is provided, and the resonant frequency in the fundamental frequency band become, e.g., the frequency f1 shown by the solid line in FIG. 6C when no inductance is provided.

However, the states of electromagnetic coupling between the feed radiation electrode 4 and the non-feed radiation electrode 5, caused when the inductance is provided to the feed radiation electrode 4 by the inductor 13 and when no inductance is provided to the feed radiation electrode 4 are different. Therefore, the impedances of the feed radiation electrode 4 and the non-feed radiation electrode 5 is mismatched. Accordingly, for example, when the inductance is not provided between the feed radiation electrode 4 and the high frequency circuit 10, the feed radiation electrode 4 and the non-feed radiation electrode 5 satisfactorily resonate in the fundamental frequency band and the higher-order frequency band, as shown by the solid line in FIG. 6C. Thus, the antenna structure 1 sufficiently operates in multi-band radio communication. On the other hand, when the inductance is provided, the resonance in the higher-order frequency band is reduced as shown by the dotted line in FIG. 6C. Thus, the higher-order frequency band cannot be utilized for radio communication. That is, problems occur since the antenna structure 1 cannot function as an antenna suitable for multi-band communication.

SUMMARY OF THE INVENTION

To overcome the problems described above, preferred embodiments of the present invention provide an antenna structure suitable for multi-band radio communication of which the resonant frequency in the fundamental frequency band can be changed without hazardous effects on the resonant state of a higher-order frequency band, and a communication device provided with the antenna structure.

According to a preferred embodiment of the present invention, an antenna structure includes a feed radiation electrode having a plurality of resonance frequencies that are different from each other, the feed radiation electrode being associated with a base plate, one end of the feed radiation electrode being a feed end portion and the other end thereof being an open end portion. The antenna structure is suitable for multi-band radio communication which is performed by the antenna operation of the feed radiation electrode.

The antenna structure further includes a ground portion disposed on the base plate, a ground connection line coupling the open end portion of the feed radiation electrode to the ground portion, a switch included in the ground connection line and being operative to selectively change from one of the on-state of the ground connection line to the other of the off-state of the ground connection line, and a capacitance-rendering portion for rendering a capacitance between the open end portion of the feed radiation electrode and the ground portion. When the ground connection line is changed to the on-state by the switch, a capacitance generated by the capacitance-rendering portion is provided between the open end portion of the feed radiation electrode and the ground portion, such that the resonant frequency in a fundamental frequency band which is the lowest of the plurality of frequency bands is changed to be lower corresponding to the capacitance rendered by the capacitance-rendering portion, and when the ground connection line is changed to the off-state by the switch, the resonant frequency in the fundamental frequency band is changed to be higher corresponding to the decreased amount of the capacitance between the open end portion of the feed radiation electrode and the ground portion which is caused when the capacitance by the capacitance-rendering portion ceases to be rendered.

According to preferred embodiments of the present invention, the capacitance-rendering portion is arranged so as to render a capacitance between the open end portion of the feed radiation electrode and the ground portion. The switch is provided for changing the state in which a capacitance is rendered between the feed radiation electrode and the ground portion and the state in which a capacitance is not rendered between them, or a capacitance switching portion is provided for variably changing the capacitance rendered by the capacitance-rendering portion.

In particular, according to a preferred embodiment of the present invention, a capacitance is not rendered between the entire feed radiation electrode and the ground portion, but a capacitance may be locally rendered between the open end portion of the feed radiation electrode and the ground portion, and the capacitance between the open end portion of the feed radiation electrode and the ground portion may be changed. The capacitance between the open end portion of the feed radiation electrode and the ground portion significantly influences the resonant frequency in the fundamental frequency band. According to a preferred embodiment of the present invention, with the above-described configuration, the capacitance between the open end portion of the feed radiation electrode and the ground portion can be changed. Thereby; the resonant frequency in the fundamental frequency band can be changed. The capacitance between the open end portion of the feed radiation electrode and the ground portion also influences the resonant frequencies in a higher-order frequency band. However, it has been confirmed by experiments by the inventor of the present invention that the degree of influence is relatively small as compared to the influence on the fundamental frequency band. Since the degree with which the capacitance between the open end portion of the feed radiation electrode and the ground portion influences the resonant frequencies in the higher-order frequency band is small as described above, the resonant frequencies in the higher-order frequency band are not substantially changed when the capacitance between the open end portion of the feed radiation electrode and the ground portion is changed. Thus, the resonant state of the feed radiation electrode in the higher-order frequency band is not deteriorated.

According to preferred embodiments of the present invention, with the above-described configuration, the resonant frequency in the fundamental frequency band can be changed with the resonant state of the feed radiation electrode in the higher-order frequency band remaining substantially unchanged.

The above-described advantages can be also obtained by any one of the capacitance-rendering portions defined by one or more capacitors including the open end portion of the feed radiation electrode and one or more electrodes arranged in opposition to the open end portion, the capacitance-rendering portion being defined by one or more capacitor portions, and the capacitance-rendering portion being defined by one or more varicap diodes.

Preferably, at least a portion of the feed radiation electrode is arranged on a dielectric substrate. Thus, the electrical length of the feed radiation electrode with respect to a signal for radio communication (high frequency signal) can be increased due to the wavelength shortening effect of the dielectric substrate. The feed radiation electrode having at least a portion arranged on the dielectric substrate can be reduced in effective length as compared to the feed radiation electrode not arranged on the dielectric substrate when the feed radiation electrodes have the same frequencies. Accordingly, the size of the antenna structure can be reduced by arranging at least a portion of the feed radiation electrode on the dielectric substrate.

In some cases, the width of the higher-order frequency band caused by the feed radiation electrode is less than that of the fundamental frequency band, and thus, is unsuitable for radio communication because of the insufficient bandwidth. In such cases, a non-feed radiation electrode which is electromagnetically coupled to the feed radiation electrode may be provided, such that a double resonant state is generated in the higher-order frequency band by the feed radiation electrode and the non-feed radiation electrode, and thus, the width of the higher-order frequency band is increased due to the double resonance. That is, in the case where, when only the feed radiation is provided, the antenna structure is unsuitable for radio communication, the non-feed radiation electrode is provided such that the double resonant state is generated in the higher-order frequency band. Thereby, the radio communication can be performed in the plurality of frequency bands, i.e., the fundamental frequency band and the higher-order frequency band. Thus, the antenna structure is suitable for multi-band radio communication.

Preferably, at least a portion of the feed radiation electrode is arranged on the dielectric substrate, and at least a portion of the non-feed radiation electrode is arranged on the same dielectric substrate. Thereby, the effective length of the feed radiation electrode and also the practical length of the non-feed radiation electrode can be reduced. Thus, the size of the antenna structure can be reduced.

In the communication device in accordance with another preferred embodiment of the present invention, including the antenna structure having the above-described configuration, the resonant frequency in the fundamental frequency band can be changed while the state of radio communication using the higher-order frequency band is maintained satisfactory. The radio communication may be performed in at least three frequency bands. Thus, the antenna structure is suitable for multi-band radio communication.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 6A:
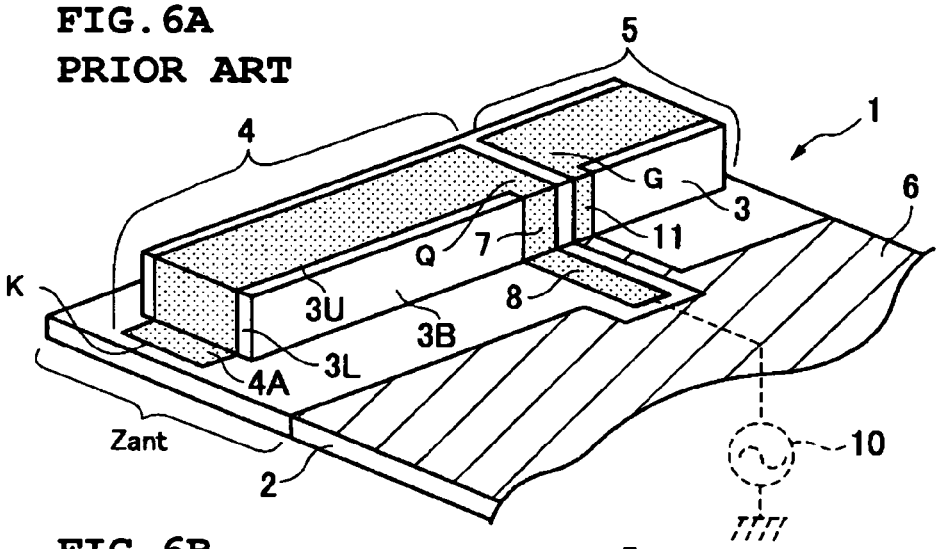
FIG. 6A PRIOR ART
FIG. 6A illustrates an example of an antenna structure which is suitable for multi-band radio communication.
Figure 6B:
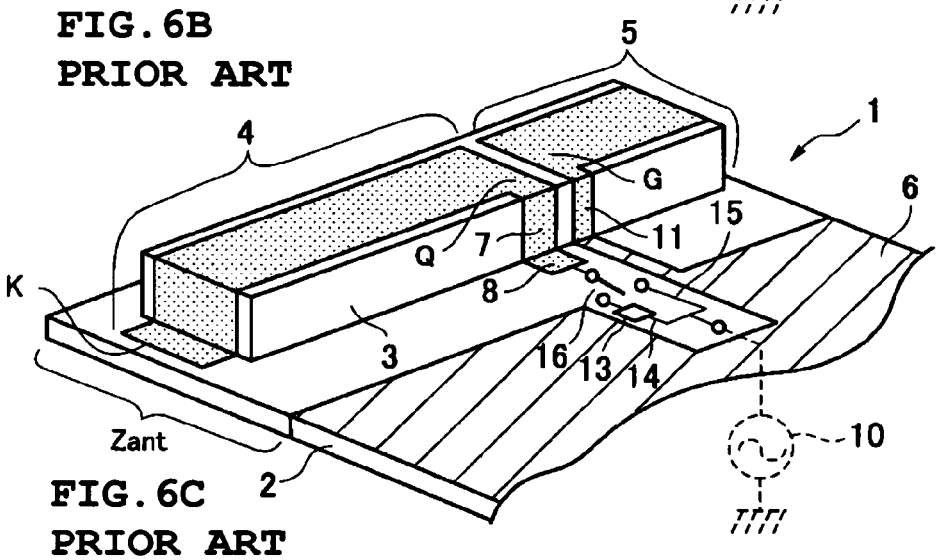
FIG. 6B PRIOR ART
FIG. 6B illustrates another example of the antenna structure which is suitable for multi-band radio communication.
Figure 6C:
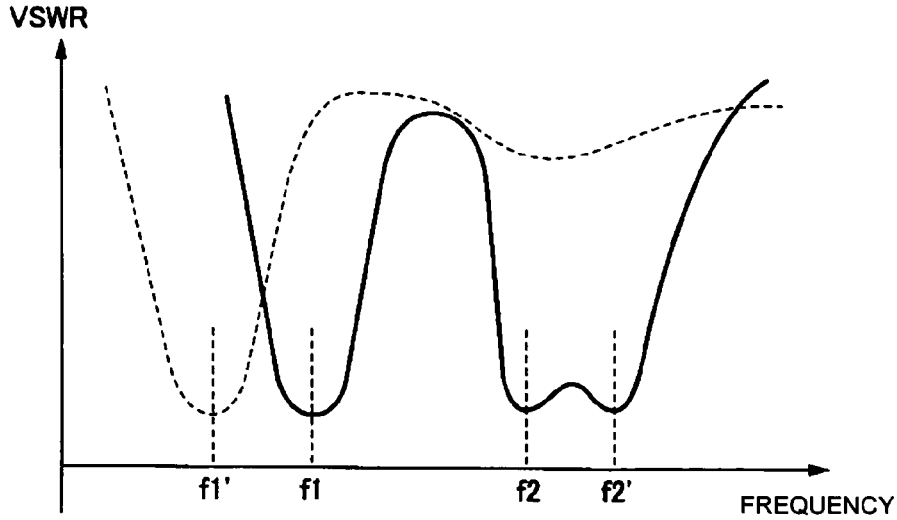
FIG. 6C PRIOR ART
FIG. 6C is a graph showing a relationship between the VSWR characteristic and the frequency.

Hereinafter, an antenna structure according to preferred embodiments of the present invention will be described with reference to drawings. The same components or elements as those of an antenna structure shown in FIGS. 6A and 6B are designated by the same reference numerals, and the description thereof is omitted.

Figure 1A:
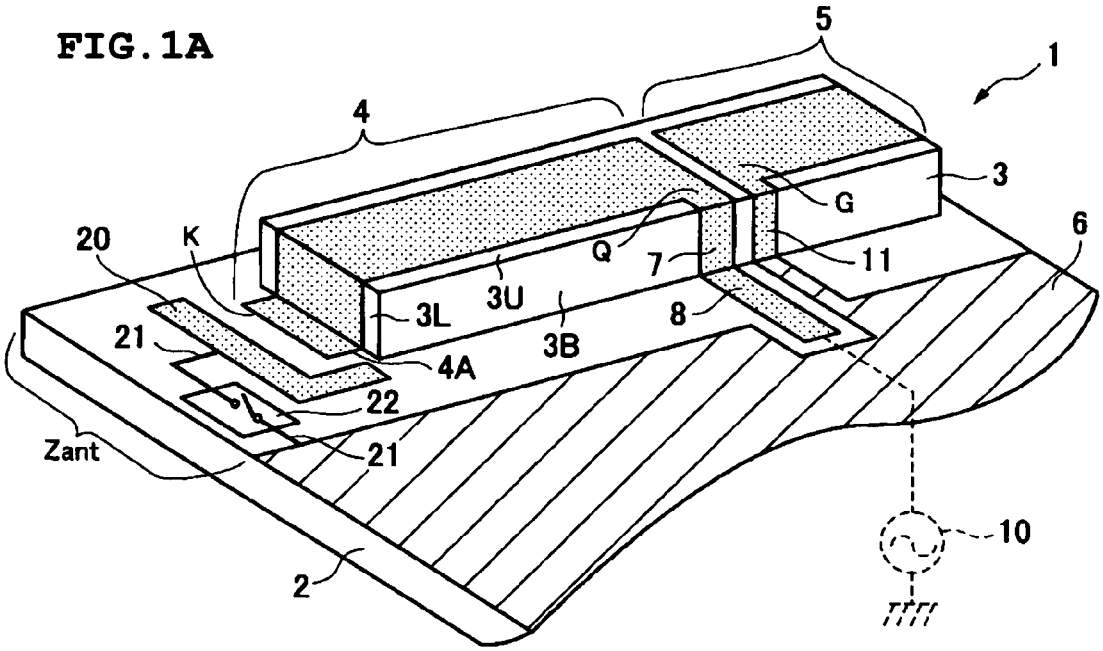
FIG. 1A illustrates an antenna structure according to a first preferred embodiment of the present invention.

FIG. 1A is a schematic perspective view of an antenna structure according to a first preferred embodiment of the present invention. The antenna structure 1 of the first preferred embodiment includes a dielectric substrate 3 disposed on a base plate 2, a feed radiation electrode 4, a non-feed radiation electrode 5, and a ground portion 6, similarly to the antenna structures shown in FIGS. 6A and 6B.

According to the first preferred embodiment, a ground-side electrode 20 is arranged so as to be opposed, at an interval, to an open end portion K of the feed radiation electrode 4 on the surface of the base plate 2. The ground-side electrode 20 and the open end portion K of the feed radiation electrode 4 are paired so as to define a capacitor.

Moreover, a ground connection line 21 for connecting the ground-side electrode 20 to the grounding portion 6 is provided. A switch 22 for selectively switching the ground connection line 21 from the on state to the off-state thereof is included in the ground connection line 21. According to the first preferred embodiment, the ground-side electrode 20 is connected to the ground portion 6 via the ground connection line 21. Thus, the capacitor defined by the ground-side electrode 20 and the open end portion K of the feed radiation electrode 4 is a capacitance-rendering portion for rendering a capacitance between the open end portion K of the feed radiation electrode 4 and the ground portion 6.

The configuration of the antenna structure according to the first preferred embodiment is the same as the configuration of the antenna structure 1 shown in FIG. 6A, except that the above-described capacitance-rendering portion, the ground connection line 21, and the switch 22 are provided.

Figure 1B:
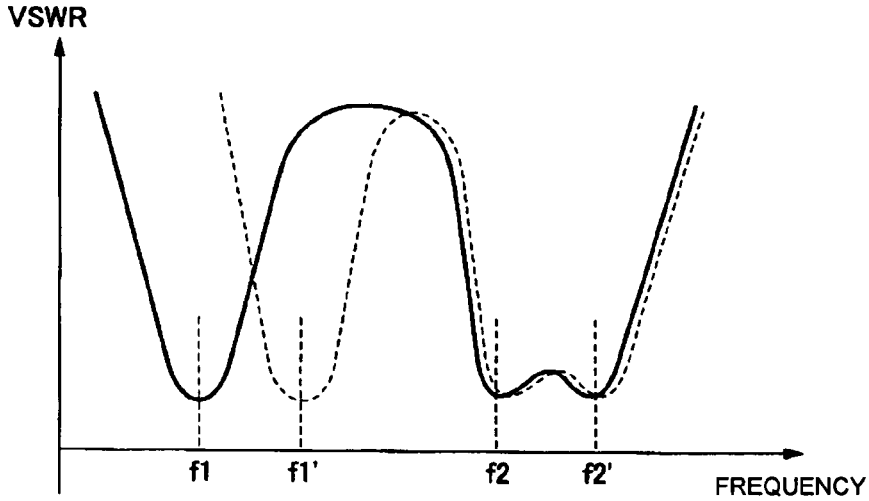
FIG. 1B is a graph showing a relationship between the VSWR characteristic and the frequency.

According to the first preferred embodiment, the switch 22 is switched based on a switch-over control signal from a control circuit (not shown) of, e.g., a communication device, such that the ground connection line 21 is switched to the on-state. Then, the static capacitance of the capacitor (capacitance rendering portion) defined by the ground-side electrode 20 and the open end portion K of the feed radiation electrode 4 is rendered between the open end portion K of the feed radiation electrode 4 and the ground portion 6. In this case, a VSWR characteristic, caused by the feed radiation electrode 4 and the non-feed radiation electrode 5, is shown by a solid line curve in FIG. 1B is obtained. In particular, the resonant frequency in the fundamental frequency band, caused by the feed radiation electrode 4, is shown at frequency f1, and a double resonant state is generated in a higher-order frequency band, due to the feed radiation electrode 4 and the non-feed radiation electrode 5.

When the switch 22 is switched based on a switch-over control signal from the control circuit of the communication device, such that the ground connection line 21 changes to the off-state, no static capacitance of the capacitor defined by the ground-side electrode 20 and the open end portion K of the feed radiation electrode 4 is rendered between the open end portion K of the feed radiation electrode 4 and the ground portion 6. Thereby, the static capacitance between the open end portion K of the feed radiation electrode 4 and the ground portion 6 is reduced. Thus, the resonant frequency in the fundamental frequency band is shifted toward the higher frequency side corresponding to the reduced capacitance, and becomes frequency f1' shown by dotted line in FIG. 1B.

According to the first preferred embodiment, even if the on-off states of the ground connection line 21 are switched from one to another, such that the resonant frequencies in the fundamental frequency band change, the resonant state in the higher-order frequency band is maintained. This is clearly seen when the VSWR characteristic obtained in the on-state, shown by solid line in FIG. 1B is compared to the VSWR characteristic obtained in the off-state, shown by dotted line in FIG. 1B. That is, according to the first preferred embodiment, the resonant frequencies in the fundamental frequency band can be switched from one to the other while the resonant state in the higher-order frequency band not substantially changed.

According to the first preferred embodiment, the capacitance-rendering portion includes the capacitor defined by the ground-side electrode 20 and the open end portion K of the feed radiation electrode 4. Alternatively, the capacitance-rendering portion shown in FIG. 2A may be provided in place of the above-described configuration. In an example shown in FIG. 2A, the open end portion K of the feed radiation electrode 4 and a ground-side electrode 24 are arranged adjacent to each other at an interval between them, and a capacitor portion 25 is disposed so as to extend between the open end portion K of the feed radiation electrode 4 and the ground-side electrode 24. The ground-side electrode 24 is connected to the ground portion 6 via the ground connection line 21. A switch 22 is included in the ground connection line 21. In the example shown in FIG. 2A, the capacitor portion 25 defines the capacitance-rendering portion for rendering a capacitance between the open end portion K of the feed radiation electrode 4 and the ground portion 6.

Figure 2A:
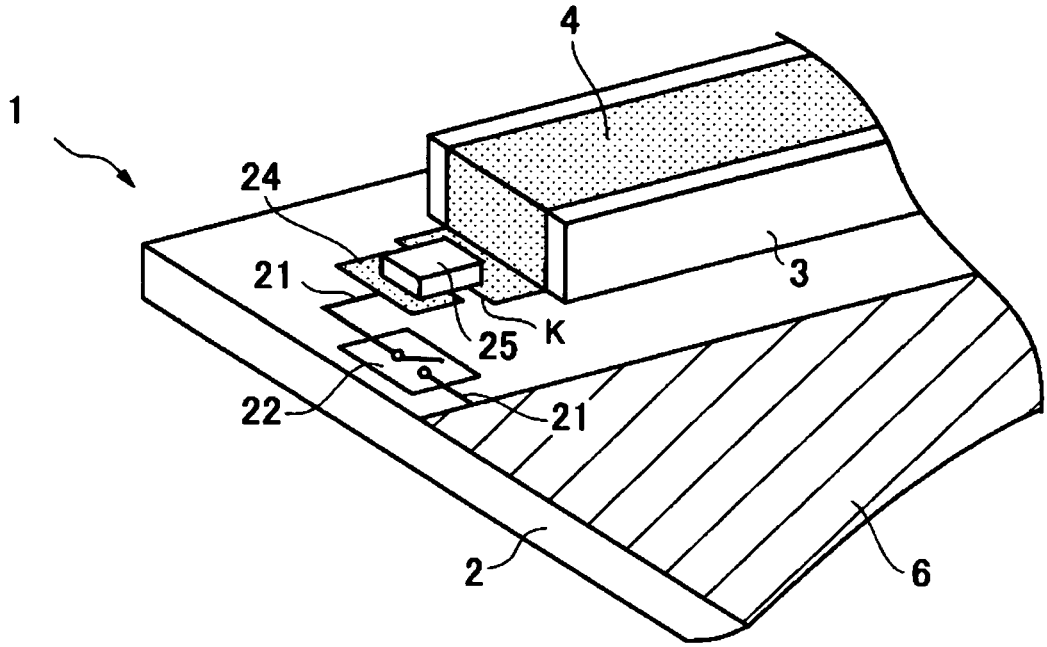
FIG. 2A illustrates a modification of the antenna structure shown in FIG. 1A.
Figure 2B:
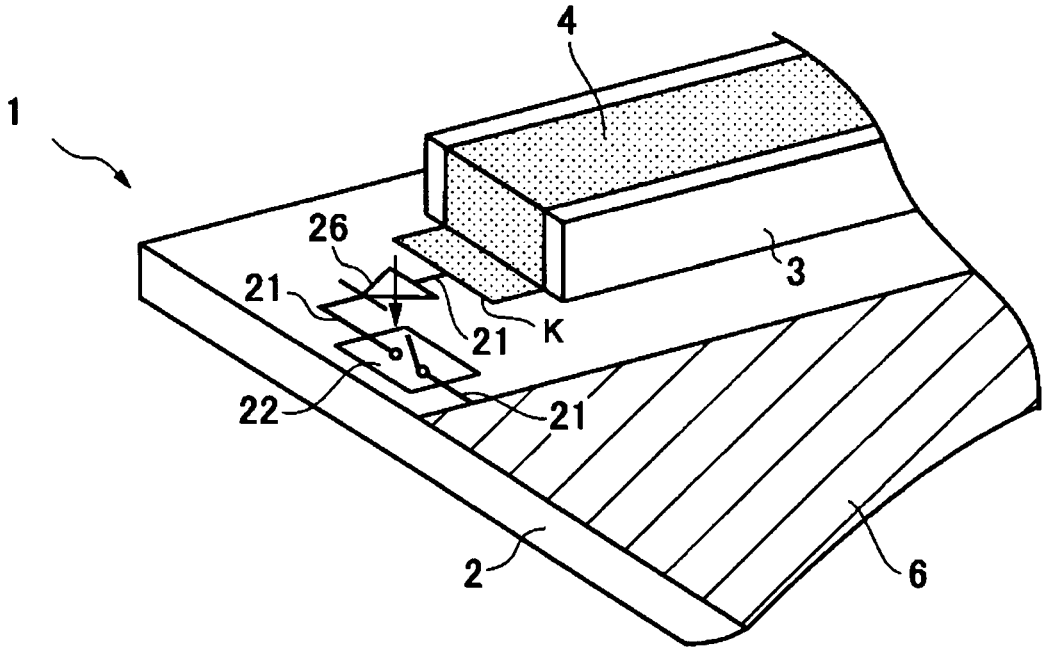
FIG. 2B illustrates another modification of the antenna structure shown in FIG. 1A.

Moreover, the capacitance-rendering portion may have a configuration as shown in FIG. 2B. In particular, the ground connection line 21 is provided for connecting the open end portion K of the feed radiation electrode 4 to the ground portion 6. A varicap diode having a parasitic capacitance and the switch 22 are included in the ground connection line 21. In the example shown in FIG. 2B, the varicap diode defines the capacitance-rendering portion between the open end portion K of the feed radiation electrode 4 and the ground portion 6.

When the capacitance-rendering portions as shown in FIGS. 2A and 2B are provided, the resonant frequencies in the fundamental frequency band can be switched from one to the other, similarly to the capacitance-rendering portion having the configuration shown in FIG. 1A. Thus, similar effects are obtained.

Hereinafter, an antenna structure according to a second preferred embodiment of the present invention will be described. In the second preferred embodiment, the same elements as those in the first preferred embodiment are designated by the same reference numerals, and the description thereof is omitted.

Figure 3A:
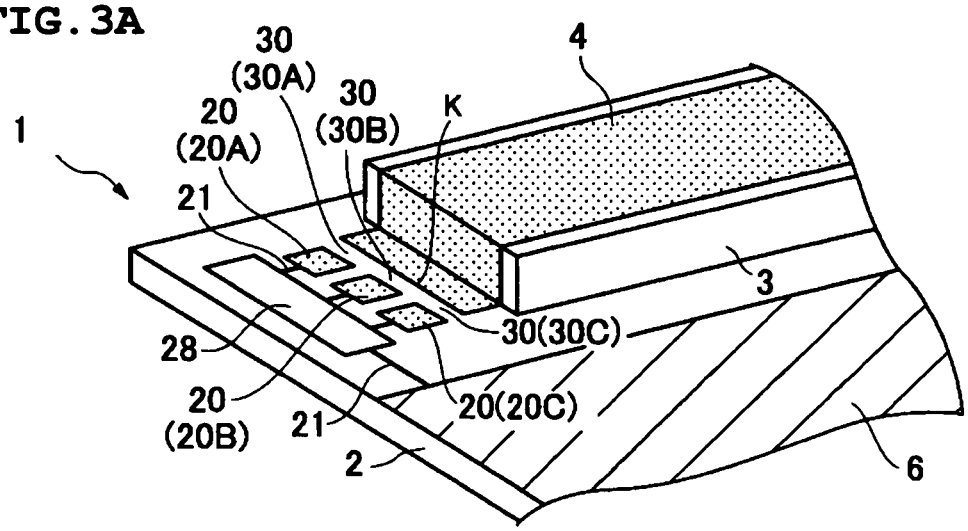
FIG. 3A illustrates an example of an antenna structure according to a second preferred embodiment of the present invention.
Figure 3B:
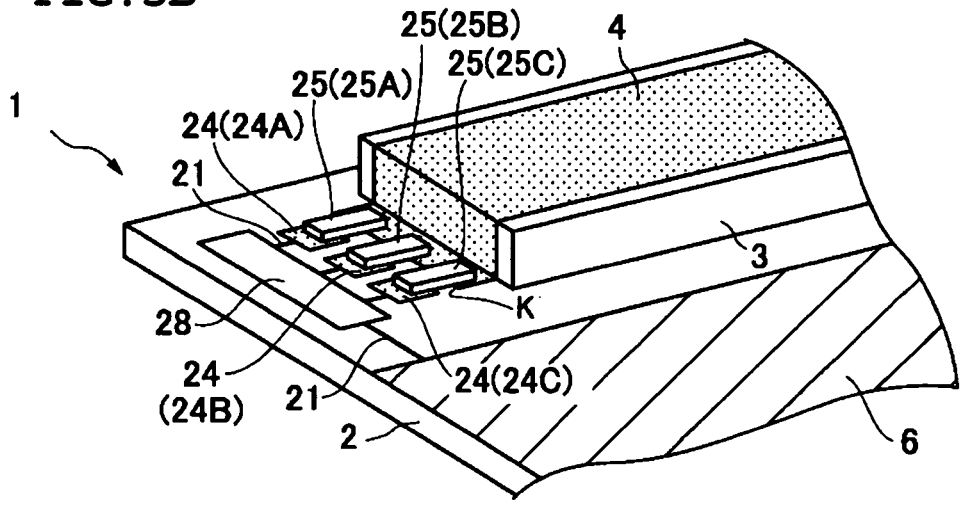
FIG. 3B illustrates another example of an antenna structure according to a second preferred embodiment of the present invention.

According to the above-described first preferred embodiment, the state in which the capacitance of the capacitance-rendering portion is rendered between the open end portion K of the feed radiation electrode 4 and the ground portion 6 is changed to the state in which the capacitance is not rendered between them, and vice versa, and thereby, the resonant frequencies in the fundamental frequency band are changed from one to the other. On the other hand, according to the second preferred embodiment, the capacitance to be rendered between the open end portion K of the feed radiation electrode 4 and the ground portion 6 is variably changed, and thereby, the resonant frequencies in the fundamental frequency band are variably changed. FIGS. 3A to 3B show examples of the configuration of the capacitance-rendering portion according to the second preferred embodiment. FIGS. 3A to 3B show a portion of the configuration that is unique to the second preferred embodiment. The other portion of the configuration, not shown, is similar to that of the configuration according to the first preferred embodiment.

In the example shown in FIG. 3A, three ground-side electrodes 20A, 20B, and 20C are arranged so as to be opposed to the open end portion K of the feed radiation electrode 4 at an interval therebetween. Each of the ground-side electrodes 20A to 20C is paired with the open end portion K of the feed radiation electrode 4 to define capacitors 30A, 30B, and 30C. Each of the capacitors 30A to 30C (each of the ground-side electrodes 20A to 20C) are connected to the ground portion 6 via the ground connection line 21 and a capacitance switching portion 28 which will be described below. That is, equivalently, the capacitors 30A to 30C are connected in parallel between the open end portion K of the feed radiation electrode 4 and the ground portion 6. The capacitors 30A to 30C define a capacitance-rendering portion for rendering a capacitance between the open end portion K of the feed radiation electrode 4 and the ground portion 6.

The capacitance switching portion 28 individually controls the on-off connection states between the capacitors 30A to 30C and the ground portion 6, such that the capacitances to be rendered between the open end portion K of the feed radiation electrode 4 and the ground portion 6 by the capacitance-rendering portion, which is defined by the capacitors 30A to 30C, are changed from one to another. For example, it is assumed that the capacitances of the capacitors 30A to 30C are equal to each other (e.g., capacitance C). When the connection between each of the capacitors 30A to 30C and the ground portion 6 is in the off-state (version A; one of the combinations of the on-off states between each of the capacitors 30A to 30C and the ground portion 6), the capacitance rendered between the open end portion K of the feed radiation electrode 4 and the ground portion 6 by the capacitance-rendering portion is zero. When the connection between the capacitor 30A and the ground portion 6 is in the on-state, and the connection between each of the other capacitors 30B and 30C and the ground portion 6 are in the off-state (version B), the capacitance rendered between the open end portion K of the feed radiation electrode 4 and the ground portion 6 by the capacitance-rendering portion is equal to the capacitance C due to the capacitor 30A. As described above, the combinations of the on-off states between the capacitors 30A to 30C defining the capacitance-rendering portion and the ground portion 6 are changed, and thereby, the capacitances rendered between the open end portion K of the feed radiation electrode 4 and the ground portion 6 can be changed from one to another.

TABLE 1

| | Connection to ground portion | | | |
|---|---|---|---|---|
| | Capacitor 30A | Capacitor 30B | Capacitor 30C | Rendered capacitance |
| Version A | OFF | OFF | OFF | 0 |
| Version B | ON | OFF | OFF | C |
| Version C | ON | ON | OFF | 2C |
| Version D | ON | ON | ON | 3C |

Then, it is assumed that the capacitances of the capacitors 30A to 30C are different from each other. The on-off states between the capacitors 30A to 30C and the ground portion 6 are individually controlled. Thus, the combinations of the on-off states between the capacitors 30A to 30C and the ground portion 6 are changed from one to another. Thereby, the capacitances rendered between the open end portion K of the feed radiation electrode 4 and the ground portion 6 can be changed to from one to another in such a manner as listed in Table 2. Table 2 shows the capacitances rendered when the capacitor 30A has a capacitance Ca, the capacitor 30B has a capacitance Cb, and the capacitor 30*c* has a capacitance Cc.

TABLE 2

| | Connection to ground portion | | | |
|---|---|---|---|---|
| | Capacitor 30A | Capacitor30B | Capacitor 30C | Rendered capacitance |
| Version A | OFF | OFF | OFF | 0 |
| Version B | ON | OFF | OFF | Ca |
| Version C | OFF | ON | OFF | Cb |
| Version D | OFF | OFF | ON | Cc |
| Version E | ON | ON | OFF | Ca + Cb |
| Version F | ON | OFF | ON | Ca + Cc |
| Version G | OFF | ON | ON | Cb + Cc |
| Version H | ON | ON | ON | Ca + Cb + Cc |

According to the second preferred embodiment, various possible combinations of the on-off states of the connections between the capacitors 30A to 30C and the ground portion 6 are previously set for use. The capacitance switching portion 28 individually controls the on-off states of the connections between the capacitors 30A to 30C and the ground portion 6 such that one possible combination is selected.

The switching of the capacitance switching portion 28 is performed, e.g., based on a switching-control signal from a control circuit of a communication device. The capacitances rendered between the open end portion K of the feed radiation electrode 4 and the ground portion 6 by the capacitance-rendering portion (capacitors 30A to 30C) are changed from one to another by the capacitance switching portion 28. Thus, the resonant frequencies in the fundamental frequency band can be changed from one to another while the resonant state in a higher order frequency band is not substantially changed, as in the first preferred embodiment.

In the example shown in FIG. 3B, three ground-side electrodes 24 (24A to 24C) are arranged adjacently to and at a distance from the open end portion K of the feed radiation electrode 4. The ground-side electrodes 24A to 24C are connected to the ground portion 6 via the ground connection lines 21 and the capacitance switching portion 28. The capacitor portions 25 (25A to 25C) are arranged so as to extend from the ground-side electrode 24A to 24C to the open end portion K of the feed radiation electrode 4, respectively. The plurality of capacitor portions 25A to 25C are connected in parallel between the open end portion K of the feed radiation electrode 4 and the ground portion 6. The capacitor portions 25A to 25C define a capacitance-rendering portion for rendering a capacitance between the open end portion K of the feed radiation electrode 4 and the ground portion 6.

The capacitance switching portion 28 shown in FIG. 3B, similarly to the capacitance switching portion 28 shown in FIG. 3A, individually controls the on-off states of the connections between capacitor portions 25A to 25C and the ground portion 6, such that the capacitance rendered between the open end portion K of the feed radiation electrode 4 and the ground portion 6 through the capacitance-rendering portion (capacitor portions 25A to 25C) is changed.

In the example shown in FIG. 3B, the switching of the capacitance switching portion 28 is performed, e.g., based on a switching-control signal from a control circuit of a communication device, as in the example shown in FIG. 3A. Thus, the capacitance rendered between the open end portion K of the feed radiation electrode 4 and the ground portion 6 by the capacitance-rendering portion (capacitor parts 25 A to 25B) is changed by the capacitance switching portion 28. Thus, the resonant frequencies in the fundamental frequency band can be changed from one to another while the resonant state in a higher order frequency band is not substantially changed.

Figure 3C:
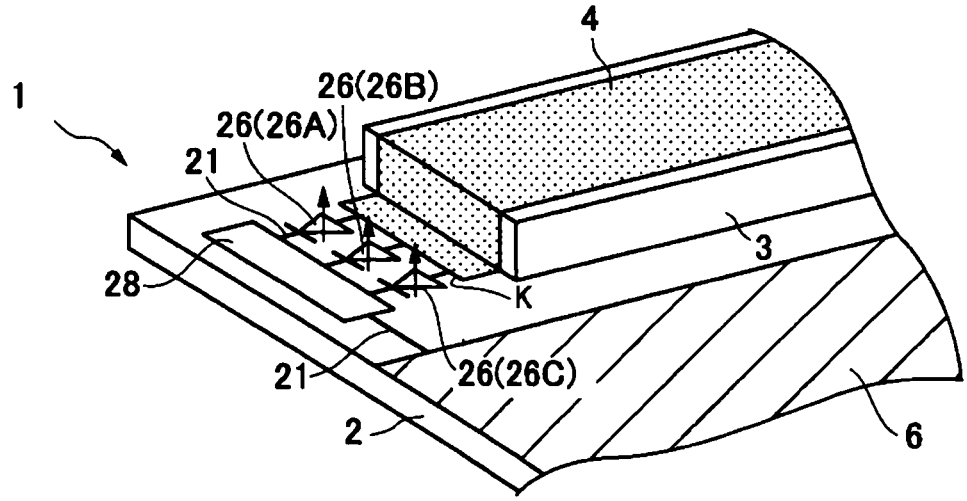
FIG. 3C illustrates still another example of an antenna structure according to a second preferred embodiment of the present invention.

In an example shown in FIG. 3C, three varicap diodes 26 (26A to 26C) are connected in parallel to the open end portion K of the feed radiation electrode 4 with the anodes thereof located on the feed radiation electrode 4 side. The cathodes of the varicap diodes 26A to 26C are connected to the ground portion 6 via the ground connection line 21 and the capacitance switching portion 28. The varicap diodes 26A to 26C define a capacitance-rendering portion for rendering a capacitance between the open end portion K of the feed radiation electrode 4 and the ground portion 6.

The capacitance switching portion 28 shown in FIG. 3C, similarly to the capacitance switching portions 28 shown in FIGS. 3A and 3B, individually controls the on-off states of the connections between the varicap diodes 26A to 26C and the ground portion 6, such that the capacitance rendered between the open end portion K of the feed radiation electrode 4 and the ground portion 6 by the capacitance-rendering portion including the varicap diodes 26A to 26C is changed. The switching of the capacitance switching portion 28 is performed, e.g., based on a switching-control signal from a control circuit of a communication device. In this case, advantages similar to those of the examples shown in FIGS. 3A and 3B are obtained.

In the second preferred embodiment, the number of the capacitors 30, that of the capacitor elements 25, and that of the varicap diodes 26 are three, respectively. However, the number of the capacitors 30, the capacitor elements 25, or the varicap diodes 26 may be two or at least four.

Hereinafter, a communication device according to a third preferred embodiment of the present invention will be described. The communication device of the third preferred embodiment is provided with one of the antenna structures 1 described in the first and the second preferred embodiments. The antenna structure is described in the first and second preferred embodiments. Thus, the description is not repeated in the third preferred embodiment.

The communication device of the third preferred embodiment is provided with the following configuration for controlling the antenna structure 1. That is, in the case where the antenna structure 1 of the first preferred embodiment is provided, one of the two resonant frequencies in the fundamental frequency band can be changed to the other resonant frequency. Accordingly, for example, the fundamental frequency band having the lower resonant frequency may be used for transmission, while the fundamental frequency band having the higher resonant frequency is used for reception. That is, a relationship between the resonant frequency changed by the switch 22 in the fundamental frequency band and the operational state of radio communication is previously set. The data regarding the relationship is stored in a memory of the communication device. A control circuit provided in the communication device outputs, to the antenna structure 1, a control signal for controlling the switching operation of the switch 22 of the antenna structure 1, based on the data regarding the relationship and the information of the operation state of radio communication.

Also, when the antenna structure 1 of the second preferred embodiment is provided, the configuration for controlling the antenna structure 1 as described above may be provided. That is, a relationship between the resonant frequency changed by the capacitance switching portion 28 of the antenna structure 1 in the fundamental frequency band and the operational state of radio communication is previously set. The data regarding the relationship is stored in a memory of a communication device. A control circuit provided in the communication device outputs, to the antenna structure 1, a control signal for controlling the switching of the capacitance switching portion 28 of the antenna structure 1, based on the data regarding the relationship and the information on the operational state of radio communication.

For the communication device, various configurations may be used. The configuration of the communication device excluding the antenna structure 1 and the portion thereof for controlling the switching of the resonant frequencies in the fundamental frequency structure of the antenna structure 1 has no particular limitations. Thus, the description is omitted.

Figure 4A:
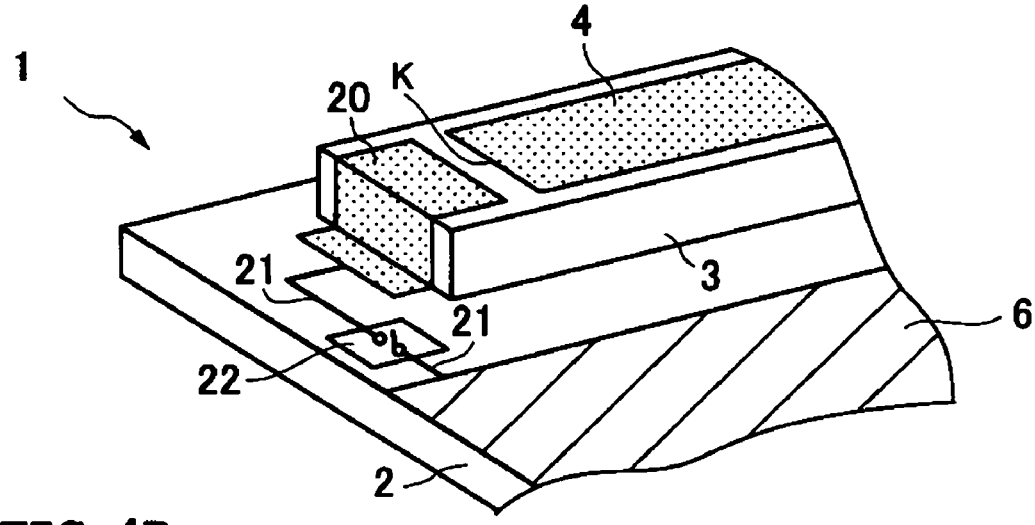
FIG. 4A illustrates an example of an antenna structure to another preferred embodiment of the present invention.
Figure 4B:
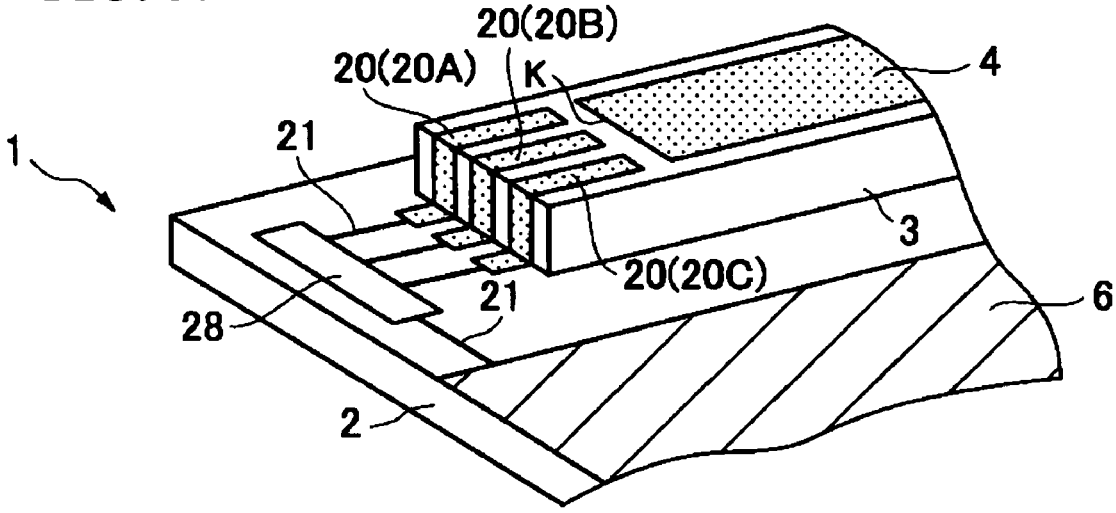
FIG. 4B illustrates another example of an antenna structure to the another preferred embodiment of the present invention.
Figure 5:
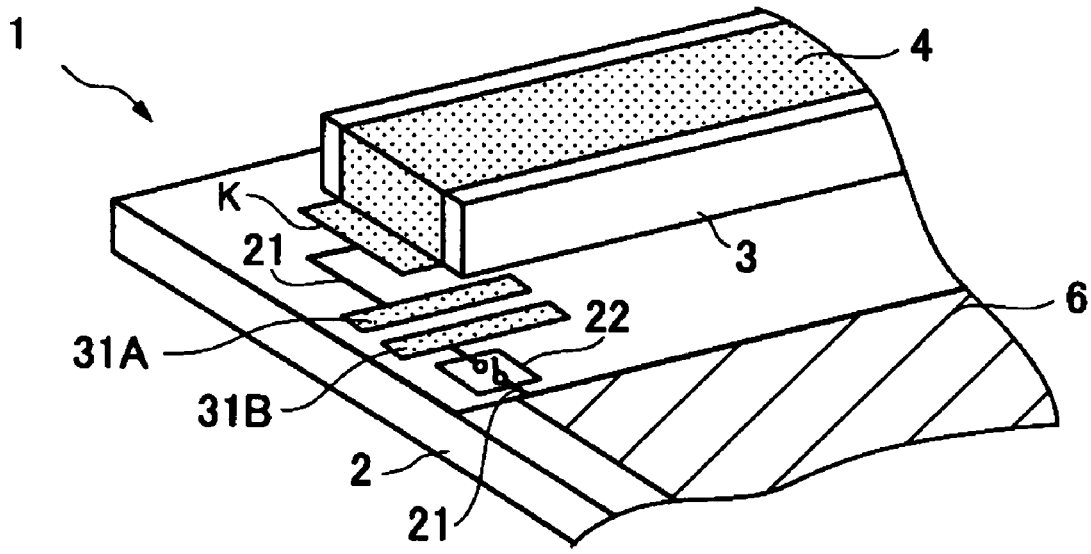
FIG. 5 illustrates an antenna structure according to still another preferred embodiment of the present invention.

The present invention is not restricted to the first to third preferred embodiments. Various alternative preferred embodiments are possible. For example, in the first to third preferred embodiments, the feed radiation electrode 4 is arranged so as to extend from the dielectric substrate onto base plate 2. Thus, a portion of the feed radiation electrode 4 is located on the base plate 2. The entire feed radiation electrode 4 may be provided on the dielectric substrate 3. Moreover, in the examples shown in FIG. 1A and FIG. 3A, the entire ground-side electrode 20 arranged so as to be opposed to the open end portion K of the feed radiation electrode 4 at an interval thereto is located on the base plate 2. For example, the entire feed radiation electrode 4 may be disposed on the dielectric substrate 3, and the ground-side electrode 20 may be arranged so as to extend from the dielectric substrate 3 onto the base plate 2, as shown in an example of FIG. 4A, which is a modification of the example of FIG. 1A and also as shown in an example of 4B, which is a modification example of FIG. 3A. In this case, the portion of the ground-side electrode 20 located on the base plate 2 functions as an underlying electrode (fixing electrode) for solder that is used when the antenna structure 1 is mounted.

Moreover, in the first to third preferred embodiments, the feed radiation electrode 4 and the non-feed radiation electrode 5 are disposed on the dielectric substrate 3, as an example. One or both of the feed radiation electrode 4 and the non-feed radiation electrode 5 may be disposed directly on the base plate 2.

Moreover, in the first to third preferred embodiments, the non-feed radiation electrode 5 is arranged to increase the width of the higher order frequency band. For example, if radio communication in the higher order frequency band is possible using only the feed radiation electrode 4 without the non-feed radiation electrode 5, the non-feed radiation electrode 5 is not required and may be omitted. Thus, the antenna structure 1 may have a configuration such that radio communication in a plurality of frequency bands can be performed using only the feed radiation electrode 4.

Furthermore, in the first to third preferred embodiments, the capacitance-rendering portion is provided by utilization of the open end portion K of the feed radiation electrode 4. For example, an electrode 31A connected to the open end portion K of the feed radiation electrode 4 via the ground connection line 21 may be provided, and an electrode 31B connected to the ground portion 6 via the ground connection line 21 may be provided such that the electrodes 31A and 31B are opposed to each other at an interval therebetween. Thus, a capacitor defined by the electrodes 31A and 31B may define a capacitance rendering portion, or a capacitor portion 25 may be arranged so as to extend between the electrodes 31A and 31B.

The shapes of the feed radiation electrode 4 and the non-feed radiation electrode 5 are not restricted to those shown in FIGS. 1A to 5. Other shapes may be adopted.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. An antenna structure suitable for multi-band radio communication, comprising:

a feed radiation electrode having a plurality of resonance frequencies that are different from each other, the feed radiation electrode being arranged in proximity to a base plate, one end of the feed radiation electrode being a feed end portion at which a feeding electrode is disposed and connected to the one end of the feed radiation electrode, the other opposite end thereof being an open end portion;

a ground portion disposed on the base plate;

a ground connection line coupling the open end portion of the feed radiation electrode to the ground portion;

a switch included in the ground connection line and being operative to selectively change one of an on-state of the ground connection line and an off-state of the ground connection line to the other of the on-state and the off-state; and a capacitance-rendering portion for rendering a capacitance between the open end portion of the feed radiation electrode and the ground portion; wherein when the ground connection line is changed from the off-state to the on-state of the connection by switching of the switch, a capacitance generated by the capacitance-rendering portion is rendered between the open end portion of the feed radiation electrode and the ground portion, such that the resonant frequency in a fundamental frequency band which is lowest of the plurality of frequency bands based on the antenna operation of the feed radiation electrode is reduced corresponding to the rendered capacitance, and when the ground connection line is changed from the on-state to the off-state of the connection by switching of the switch, the resonant frequency in the fundamental frequency band is increased corresponding to the decreased amount of the capacitance between the open end portion of the feed radiation electrode and the ground portion which is caused when the capacitance by the capacitance-rendering portion ceases to be rendered.

2. An antenna structure according to claim 1, further comprising:

an electrode arranged so as to be opposed to the open end portion of the feed radiation electrode with an interval therebetween, the electrode being paired with the open end portion of the feed radiation electrode to define a capacitor; wherein the ground connection line connects the electrode to the ground portion; and the capacitor defined by the electrode and the open end portion of the feed radiation electrode defines the capacitance-rendering portion.

3. An antenna structure according to claim 2, wherein the entire feed radiation electrode is disposed on a dielectric substrate such that the feed radiation electrode is arranged in the proximity of the base plate via the dielectric substrate, and at least a portion of the electrode arranged so as to be opposed to the open end portion of the feed radiation electrode is disposed on the dielectric substrate.

4. An antenna structure according to claim 1, further comprising:

an electrode arranged adjacent to the open end portion of the feed radiation electrode with an interval therebetween; wherein the ground connection line connects the electrode to the ground portion; and a capacitor portion is arranged so as to extend between the open end portion of the feed radiation electrode and the electrode adjacent to the open end portion, the capacitor portion defines the capacitance-rendering portion.

5. An antenna structure according to claim 1, wherein the capacitance-rendering portion includes a varicap diode having a parasitic capacitance.

6. An antenna structure according to claim 1, further comprising:

a plurality of ground-side electrodes arranged so as to be opposed to the open end portion of the feed radiation electrode with an interval therebetween and connected to the ground portion, the plurality of ground-side electrodes and the open end portion of the feed radiation electrode defining a plurality of capacitors equivalently connected in parallel between the open end portion of the feed radiation electrode and the ground portion, the plurality of capacitors defining the capacitance-rendering portion; wherein the switch includes a capacitance switching portion, the capacitance switching portion is operative to individually control the on-off state of the connections between the respective capacitors and the ground portion such that the connection state between the capacitors and the ground portion is changed to the connection state defined by one combination selected from a plurality of combinations of on-states and off-states of the connections between the respective capacitors and the ground portion previously set, and thus, the capacitance rendered between the open end portion of the feed radiation electrode and the ground portion by the capacitance-rendering portion is variably controlled such that a resonant frequency in the fundamental frequency band is changed according to the capacitance changed by the capacitance switching portion.

7. An antenna structure according to claim 1, further comprising:

a plurality of ground-side electrodes arranged so as to be opposed to the open end portion of the feed radiation electrode with an interval therebetween and connected to the ground portion;

a plurality of capacitor portions arranged so as to extend between the ground-side electrodes and the open end portion of the feed radiation electrode and equivalently connected in parallel between the open end portion of the feed radiation electrode and the ground portion, the plurality of capacitor portions defines the capacitance-rendering portion; wherein the switch includes a capacitance switching portion, the capacitance switching portion is operative to individually control the on-off states of the connections between the respective capacitor portions and the ground portion such that the connection state between the capacitor portions and the ground portion is changed to the connection state defined by one combination selected from a plurality of combinations of on-states and off-states of the connections between the respective capacitor portions and the ground portion previously set, and thus, the capacitance rendered between the open end portion of the feed radiation electrode and the ground portion by the capacitance-rendering portion is variably controlled such that a resonant frequency in the fundamental frequency band is changed according to the capacitance changed by the capacitance switching portion.

8. An antenna structure according to claim 1, further comprising:

a parallel combination of a plurality of varicap diodes having parasitic capacitances interposed in the ground connection line; wherein the switch includes a capacitance switching portion, the capacitance switching portion is operative to individually control the on-off states of the connections between the respective varicap diodes and the ground portion such that the connection state between the varicap diodes and the ground portion is changed to the connection state defined by one combination selected from a plurality of combinations of on-states and off-states of the connections between the respective varicap diodes and the ground portion previously set, and thus, the capacitance rendered between the open end portion of the feed radiation electrode and the ground portion by the capacitance-rendering portion is variably controlled such that a resonant frequency in the fundamental frequency band is changed according to the capacitance changed by the capacitance switching portion.

9. An antenna structure according to claim 1, wherein at least a portion of the feed radiation electrode is disposed on a dielectric substrate such that the feed radiation electrode is arranged in the proximity of the base plate via the dielectric substrate.

10. An antenna structure according to claim 1, further comprising a non-feed radiation electrode arranged at an interval from the feed radiation electrode, in which the non-feed radiation electrode is electromagnetically coupled to the feed radiation electrode so as to perform antenna operation and generate a double resonant state in a higher-order frequency band that is higher than the fundamental frequency band.

11. An antenna structure according to claim 10, wherein at least a portion of the feed radiation electrode is disposed on a dielectric substrate, and is arranged in the proximity of the base plate via the dielectric substrate, and at least a portion of the non-feed radiation electrode is disposed on the dielectric substrate on which the feed radiation electrode is provided.

12. An antenna structure according to claim 1, wherein at least a portion of the feed radiation electrode is provided on the base plate such that the feed radiation electrode is directly connected to the base plate.

13. A communication device including the antenna structure according to claim 1.

* * * * *